US010121486B2

(12) United States Patent
Norvell et al.

(10) Patent No.: US 10,121,486 B2
(45) **Date of Patent: *Nov. 6, 2018**

(54) AUDIO SIGNAL CLASSIFICATION AND CODING

(71) Applicant: Telefonaktiebolaget LM Ericsson (publ), Stockholm (SE)

(72) Inventors: Erik Norvell, Stockholm (SE); Stefan Bruhn, Sollentuna (SE)

(73) Assignee: Telefonaktiebolaget LM Ericsson, Stockholm (SE)

( * ) Notice: Subject to any disclaimer, the term of this patent is extended or adjusted under 35 U.S.C. 154(b) by 0 days.

This patent is subject to a terminal disclaimer.

(21) Appl. No.: 15/797,725

(22) Filed: Oct. 30, 2017

(65) Prior Publication Data

US 2018/0047404 A1 Feb. 15, 2018

Related U.S. Application Data

(63) Continuation of application No. 15/488,967, filed on Apr. 17, 2017, now Pat. No. 9,837,095, which is a (Continued)

(51) Int. Cl.

| | |
|---|---|
| ***G10L 19/00*** | (2013.01) |
| ***G10L 25/00*** | (2013.01) |
| ***G10L 19/20*** | (2013.01) |
| ***G10L 25/18*** | (2013.01) |

(52) U.S. Cl.
CPC ..... *G10L 19/20* (2013.01); *G10L 25/18* (2013.01)

(58) Field of Classification Search
CPC ..... G10L 19/00; G10L 19/20; G10L 25/18; G10L 19/087; G10L 19/24
(Continued)

(56) References Cited

U.S. PATENT DOCUMENTS

| | | | |
|---|---|---|---|
| 6,256,487 | B1 | 7/2001 | Bruhn |
| 8,775,169 | B2 | 7/2014 | Gao |

(Continued)

FOREIGN PATENT DOCUMENTS

| | | | |
|---|---|---|---|
| EP | 2 407 964 | A2 | 1/2012 |
| RU | 2470384 | C1 | 12/2012 |

(Continued)

OTHER PUBLICATIONS

PCT Notification of Transmittal of the International Search Report and the Written Opinion of the International Searching Authority, or the Declaration for International application No. PCT/SE2015/050531—dated Aug. 3, 2015.

(Continued)

*Primary Examiner* — Charlotte M Baker
(74) *Attorney, Agent, or Firm* — Baker Botts, LLP

(57) ABSTRACT

The invention relates to a codec and a signal classifier and methods therein for signal classification and selection of a coding mode based on audio signal characteristics. A method embodiment to be performed by a decoder comprises, for a frame m: determining a stability value D(m) based on a difference, in a transform domain, between a range of a spectral envelope of frame m and a corresponding range of a spectral envelope of an adjacent frame m−1. Each such range comprises a set of quantized spectral envelope values related to the energy in spectral bands of a segment of the audio signal. The method further comprises selecting a decoding mode, out of a plurality of decoding modes, based on the stability value D(m); and applying the selected decoding mode.

15 Claims, 9 Drawing Sheets

Related U.S. Application Data continuation of application No. 14/649,573, filed as application No. PCT/SE2015/050531 on May 12, 2015, now Pat. No. 9,666,210.

(60) Provisional application No. 61/993,639, filed on May 15, 2014.

(58) Field of Classification Search
USPC ..... 704/201, 500
See application file for complete search history.

(56) References Cited

U.S. PATENT DOCUMENTS

| | | | |
|---|---|---|---|
| 2008/0312914 | A1 | 12/2008 | Rajendran et al. |
| 2013/0110507 | A1 | 5/2013 | Gao |

FOREIGN PATENT DOCUMENTS

| | | | |
|---|---|---|---|
| RU | 2507609 | C2 | 2/2014 |
| WO | WO 2009/055192 | A1 | 4/2009 |
| WO | WO 2010/031003 | A1 | 3/2010 |

OTHER PUBLICATIONS 5.4 Concealment Operation Related to MDCT Modes; 3GPP TS 26.447 V0.0.1; Release 12—dated May 2014.

Russian Federal Service on Industrial Property, Official Action of Substantive Examination, Application No. 2016148874 (with English translation), dated Feb. 21, 2018.

Russian Federal Service on Industrial Property, Search Report, Application No. 2016148874, dated Feb. 21, 2018.

AUDIO SIGNAL CLASSIFICATION AND CODING

PRIORITY

This application is a continuation, under 35 U.S.C. § 120, of U.S. patent application Ser. No. 15/488,967, which is a continuation, under 35 U.S.C. § 120, of U.S. patent application Ser. No. 14/649,573 which is a U.S. National Stage Filing under 35 U.S.C. § 371 of International Patent Application Serial No. PCT/SE2015/050531, filed May 12, 2015, and entitled "Audio Signal Classification and Coding" which claims priority to U.S. Provisional Patent Application No. 61/993,639 filed May 15, 2014, all of which are hereby incorporated by reference in their entirety.

TECHNICAL FIELD

The invention relates to audio coding and more particularly to analysing and matching input signal characteristics for coding.

BACKGROUND

Cellular communication networks evolve towards higher data rates, improved capacity and improved coverage. In the 3rd Generation Partnership Project (3GPP) standardization body, several technologies have been and are also currently being developed.

LTE (Long Term Evolution) is an example of a standardised technology. In LTE, an access technology based on OFDM (Orthogonal Frequency Division Multiplexing) is used for the downlink, and Single Carrier FDMA (SC-FDMA) for the uplink. The resource allocation to wireless terminals, also known as user equipment, UEs, on both downlink and uplink is generally performed adaptively using fast scheduling, taking into account the instantaneous traffic pattern and radio propagation characteristics of each wireless terminal. One type of data over LTE is audio data, e.g. for a voice conversation or streaming audio.

To improve the performance of low bitrate speech and audio coding, it is known to exploit a-priori knowledge about the signal characteristics and employ signal modelling. With more complex signals, several coding models, or coding modes, may be used for different parts of the signals. These coding modes may also involve different strategies for handling channel errors and lost packages. It is beneficial to select the appropriate coding mode at any one time.

SUMMARY

The solution described herein relates to a low complex, stable adaptation of a signal classification, or discrimination, which may be used for both coding method selection and/or error concealment method selection, which herein have been summarized as selection of a coding mode. In case of error concealment, the solution relates to a decoder.

According to a first aspect, a method for decoding an audio signal is provided. The method comprises, for a frame m: determining a stability value D(m) based on a difference, in a transform domain, between a range of a spectral envelope of frame m and a corresponding range of a spectral envelope of an adjacent frame m−1. Each such range comprises a set of quantized spectral envelope values related to the energy in spectral bands of a segment of the audio signal. The method further comprises selecting a decoding mode, out of a plurality of decoding modes, based on the stability value D(m); and applying the selected decoding mode.

According to a second aspect, a decoder is provided for decoding an audio signal. The decoder is configured to, for a frame m: determine a stability value D(m) based on a difference, in a transform domain, between a range of a spectral envelope of frame m and a corresponding range of a spectral envelope of an adjacent frame m−1. Each such range comprises a set of quantized spectral envelope values related to the energy in spectral bands of a segment of the audio signal. The decoder is further configured to select a decoding mode, out of a plurality of decoding modes, based on the stability value D(m); and to apply the selected decoding mode.

According to a third aspect, a method for encoding an audio signal is provided. The method comprises, for a frame m: determining a stability value D(m) based on a difference, in a transform domain, between a range of a spectral envelope of frame m and a corresponding range of a spectral envelope of an adjacent frame m−1. Each such range comprises a set of quantized spectral envelope values related to the energy in spectral bands of a segment of the audio signal. The method further comprises selecting an encoding mode, out of a plurality of encoding modes, based on the stability value D(m); and applying the selected encoding mode.

According to a fourth aspect, an encoder is provided for encoding an audio signal. The encoder is configured to, for a frame m: determine a stability value D(m) based on a difference, in a transform domain, between a range of a spectral envelope of frame m and a corresponding range of a spectral envelope of an adjacent frame m−1. Each such range comprises a set of quantized spectral envelope values related to the energy in spectral bands of a segment of the audio signal. The encoder is further configured to select an encoding mode, out of a plurality of encoding modes, based on the stability value D(m); and to apply the selected encoding mode.

According to a fifth aspect, a method for audio signal classification is provided. The method comprises, for a frame m of an audio signal: determining a stability value D(m) based on a difference, in a transform domain, between a range of a spectral envelope of frame m and a corresponding range of a spectral envelope of an adjacent frame m−1, each range comprising a set of quantized spectral envelope values related to the energy in spectral bands of a segment of the audio signal. The method further comprises classifying the audio signal based on the stability value D(m).

According to a sixth aspect, an audio signal classifier is provided. The audio signal classifier is configured to, for a frame m of an audio signal: determine a stability value D(m) based on a difference, in a transform domain, between a range of a spectral envelope of frame m and a corresponding range of a spectral envelope of an adjacent frame m−1, each range comprising a set of quantized spectral envelope values related to the energy in spectral bands of a segment of the audio signal; and further to classify the audio signal based on the stability value D(m).

According to a seventh aspect, a host device is provided, comprising a decoder according to the second aspect.

According to an eighth aspect, a host device is provided, comprising an encoder according to the fourth aspect.

According to an ninth aspect, a host device is provided, comprising signal classifier according to the sixth aspect.

According to a tenth aspect, a computer program is provided, which comprises instructions which, when executed on at least one processor, cause the at least one processor to carry out the method according to the first, third and/or sixth aspect.

According to an eleventh aspect a carrier is provided, containing the computer program of the ninth aspect, wherein the carrier is one of an electronic signal optical signal, radio signal, or computer readable storage medium.

BRIEF DESCRIPTION OF THE DRAWINGS

The invention will now be described, by way of example, with reference to the accompanying drawings, in which.

DETAILED DESCRIPTION

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout the description.

Figure 1:
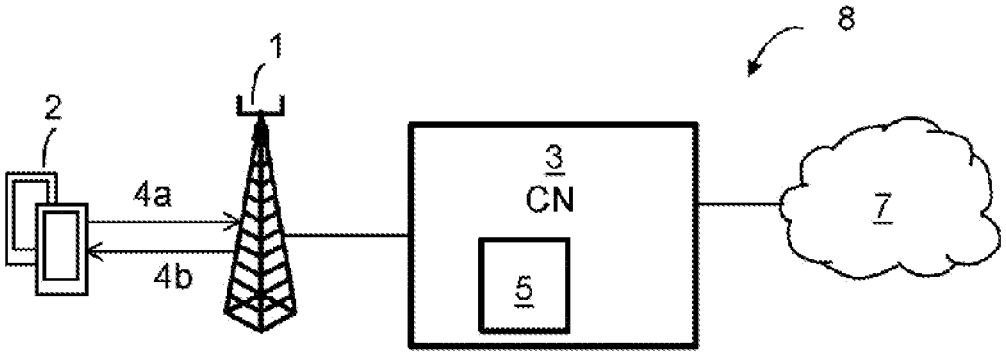
FIG. 1 is a schematic diagram illustrating a cellular network where embodiments presented herein may be applied.

FIG. 1 is a schematic diagram illustrating a cellular network 8 where embodiments presented herein may be applied. The cellular network 8 comprises a core network 3 and one or more radio base stations 1, here in the form of evolved Node Bs, also known as eNodeBs or eNBs. The radio base station 1 could also be in the form of Node Bs, BTSs (Base Transceiver Stations) and/or BSSs (Base Station Subsystems), etc. The radio base station 1 provides radio connectivity to a plurality of wireless terminals 2. The term wireless terminal is also known as mobile communication terminal, user equipment (UE), mobile terminal, user terminal, user agent, wireless device, machine-to-machine devices etc., and can be, for example, what today are commonly known as a mobile phone or a tablet/laptop with wireless connectivity or fixed mounted terminal.

The cellular network B may e.g. comply with any one or a combination of LTE (Long Term Evolution), W-CDMA (Wideband Code Division Multiplex), EDGE (Enhanced Data Rates for GSM (Global System for Mobile communication) Evolution), GPRS (General Packet Radio Service), CDMA2000 (Code Division Multiple Access 2000), or any other current or future wireless network, such as LTE-Advanced, as long as the principles described hereinafter are applicable.

Uplink (UL) 4*a* communication from the wireless terminal 2 and downlink (DL) 4*b* communication to the wireless terminal 2 between the wireless terminal 2 and the radio base station 1 is performed over a wireless radio interface. The quality of the wireless radio interface to each wireless terminal 2 can vary over time and depending on the position of the wireless terminal 2, due to effects such as fading, multipath propagation, interference, etc.

The radio base station 1 is also connected to the core network 3 for connectivity to central functions and an external network 7, such as the Public Switched Telephone Network (PSTN) and/or the Internet.

Audio data can be encoded and decoded e.g. by the wireless terminal 2 and a transcoding node 5, being a network node arranged to perform transcoding of audio. The transcoding node 5 can e.g. be implemented in a MGW (Media Gateway), SBG (Session Border Gateway)/BGF (Border Gateway Function) or MRFP (Media Resource Function Processor). Hence, both the wireless terminal 2 and the transcoding node 5 are host devices, which comprise a respective audio encoder and decoder.

Using a set of error recovery, or error concealment methods, and selecting the adequate concealment strategy depending on the instantaneous signal characteristics can in many cases improve the quality of a reconstructed audio signal.

To select the best encoding/decoding mode, an encoder and/or decoder may try all available modes in an analysis-by-synthesis, also called a closed loop fashion, or it may rely on a signal classifier which makes a decision on the coding mode based on a signal analysis, also called an open loop decision. Typical signal classes for speech signals are voiced and unvoiced speech utterances. For general audio signals, it is common to discriminate between speech, music and potentially background noise signals. Similar classification can be used for controlling an error recovery, or error concealment method.

However, a signal classifier may involve a signal analysis with a high cost in terms of computational complexity and memory resources. It is also a difficult problem to find suitable classification for all signals.

The problem of computational complexity may be avoided by use of a signal classification method using codec parameters which are already available in the encoding or decoding method, thereby adding very little additional computational complexity. A signal classification method may also use different parameters depending on the coding mode at hand, in order to give a reliable control parameter even as the coding mode changes. This gives a low complexity, stable adaptation of the signal classification which may be used for both coding method selection and error concealment method selection.

The embodiments may be applied in an audio codec operating in the frequency domain or transform domain. At the encoder, the input samples x(n) are divided into time segments, or frames, of a fixed or varying length. To denote the samples of a frame m we write x(m, n). Usually a fixed length of 20 ms is used, with the option of using a shorter window length, or frame length, for fast temporal changes; e.g. at transient sounds. The input samples are transformed to frequency domain by means of a frequency transform. Many audio codecs employ the Modified Discrete Cosine Transform (MDCT) due to its suitability for coding. Other transforms, such as DCT (Discrete Cosine Transform) or DFT (Discrete Fourier Transform) may also be used. The MDCT spectrum coefficients of frame m are found using the relation:

$$X(m,k)=\sum_{k=0}^{2L-1} x(m,n)\cos\left(\frac{\pi}{L}+\frac{1}{2}+\frac{L}{2}\right)\left(k+\frac{1}{2}\right)$$

where X(m, k) represents MDCT coefficient k in frame m. The coefficients of the MDCT spectrum are divided into groups, or bands. These bands are typically non-uniform in size, using narrower bands for low frequencies and wider bandwidth for higher frequencies. This is intended to mimic the frequency resolution of the human auditory perception and the relevant design for a lossy coding scheme. The coefficients of band b is then the vector of MDCT coefficients:

$$X(m,k), k=k_{start(b)}, k_{start(b)}+1, \ldots, k_{end(b)}$$

Where $k_{start(b)}$ and $k_{end(b)}$ denote the start and end indices of band b. The energy, or root-mean-square (RMS) value, of each band is then computed as $$E(m,b)=\sqrt{\frac{1}{k_{start(b)}-k_{end(a)}+1}\sum_{k=k_{start(b)}}^{k_{end(a)}} X(m,k)^2}$$

The band energies E(m, b) form a spectral coarse structure, or envelope, of the MDCT spectrum. It is quantized using suitable quantizing techniques, for example using differential coding in combination with entropy coding, or a vector quantizer (VQ). The quantization step produces quantization indices to be stored or transmitted to a decoder, and also reproduces the corresponding quantized envelope values $\hat{E}(m, b)$. The MDCT spectrum is normalized with the quantized band energies to form a normalized MDCT spectrum N(m, k):

$$N(m,k)=\frac{1}{\hat{E}(m,b)}X(m,k),\ k=k_{start(b)}, k_{start(b)}+1, \ldots, k_{end(b)}$$

The normalized MDCT spectrum is further quantized using suitable quantizing techniques, such as scaler quantizers in combination with differential coding and entropy coding, or vector quantization technologies. Typically, the quantization involves generating a bit allocation R(b) for each band b which is used for encoding each band. The bit allocation may be generated including a perceptual model which assigns bits to the individual bands based on perceptual importance.

It may be desirable to further guide the encoder and decoder processes by adaptation to the signal characteristics. If the adaptation is done using quantized parameters which are available both at the encoder and the decoder, the adaptation can be synchronized between encoder and decoder without the transmission of additional parameters.

The solution described herein mainly relates to adapting an encoder and/or decoder process to the characteristics of a signal to be encoded or decoded. In brief, a stability value/parameter is determined for the signal, and an adequate encoding and/or decoding mode is selected and applied based an the determined stability value/parameter. As used herein, "coding mode" may refer to an encoding mode and/or a decoding mode. As previously described, a coding mode may involve different strategies for handling channel errors and lost packages. Further, as used herein, the expression "decoding mode" is intended to refer to a decoding method and/or to a method for error concealment to be used in association with the decoding and reconstruction of an audio signal. That is, as used herein, different decoding modes may be associated with the same decoding method, but with different error concealment methods. Similarly, different decoding modes may be associated with the same error concealment method, but with different decoding methods. The solution described herein, when applied in a codec, relates to selecting a coding method and/or an error concealment method based on a novel measure related to audio signal stability.

Exemplifying Embodiments

Figure 2A:
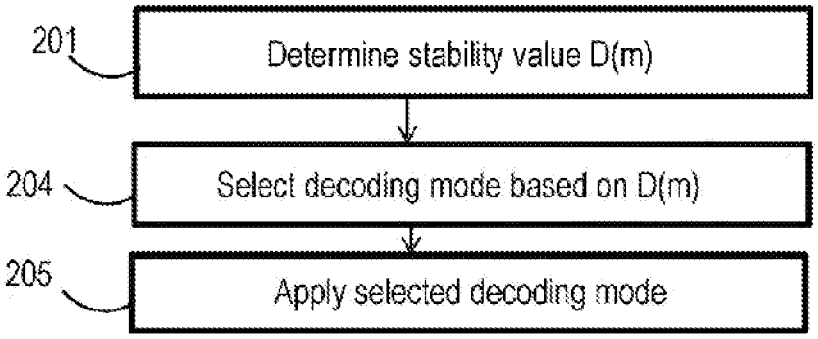
FIGS. 2*a* and 2*b* are flow charts illustrating methods performed by a decoder according to exemplifying embodiments.
Figure 2B:
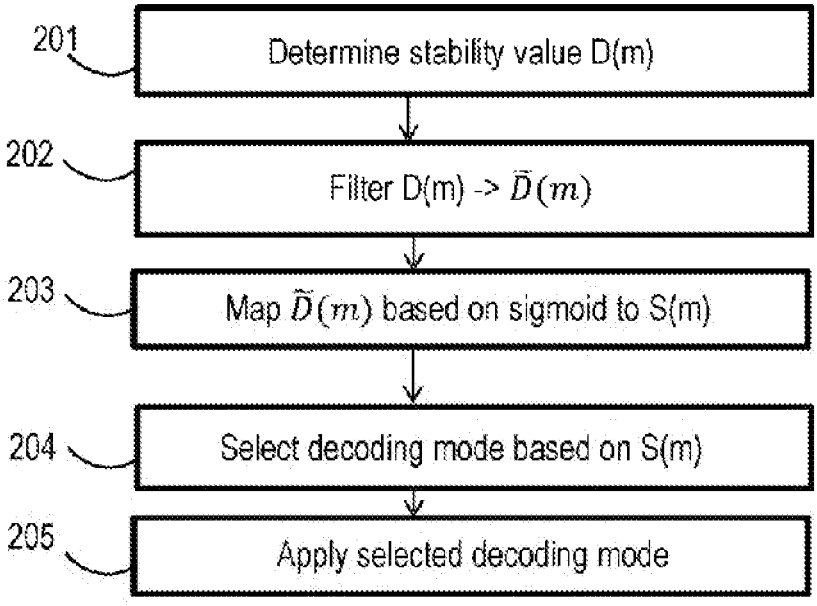

Below, exemplifying embodiments related to a method for decoding, an audio signal will be described with reference to FIGS. 2*a* and 2*b*. The method is to be performed by a decoder, which may be configured for being compliant with one or more standards for audio decoding. The method illustrated in FIG. 2*a* comprises determining 201 a stability value D(m), in a transform domain, for a frame m of the audio signal. The stability value D(m) is determined based on a difference between a range of a spectral envelope of frame m and a corresponding range of a spectral envelope of an adjacent frame m−1. Each range comprises a set of quantized spectral envelope values related to the energy in spectral bands of a segment of the audio signal. Based on the stability value D(m), a decoding mode out of a plurality of decoding modes may be selected 204. For example, a decoding method and/or an error concealment method may be selected. The selected decoding mode may then be applied 205 for decoding and/or reconstructing at least the frame in of the audio signal.

As illustrated in the figure, the method may further comprise low pass filtering 202 the stability value D(m), thus achieving a filtered stability value $\tilde{D}(m)$. The filtered stability value $\tilde{D}(m)$ may then be mapped 203 to a sealer range of [0,1] by use e.g. of a sigmoid function, thus achieving a stability parameter S(m). The selecting of a decoding mode based on D(m) would then be realized by selecting a decoding mode based on the stability parameter S(m), which is derived from D(m). The determining of a stability value and the deriving of a stability parameter may be regarded as a way of classifying the segment of the audio signal, where the stability is indicative of a certain class or type of signals.

As an example, the adaptation of a decoding procedure described may be related to selecting a method for error concealment from among a plurality of methods for error concealment based on the stability value. The plurality of error concealment methods comprised e.g. in the decoder may be associated with a single decoding method, or with different decoding methods. As previously stated, the term decoding mode used herein may refer to a decoding method and/or an error concealment method. Based on the stability value or stability parameter and possibly yet other criteria, the error concealment method which is most suitable for the concerned part of the audio signal may be selected. The stability value and parameter may be indicative of whether the concerned segment of the audio signal comprises speech or music, and/or, when the audio signal comprises music: the stability parameter could be indicative of different types of music. At least one of the error concealment methods could be more suitable for speech than for music, and at least one other error concealment method of the plurality of error concealment methods could be more suitable for music than for speech. Then, when the stability value or stability parameter, possibly combined with further refinement e.g. as exemplified below, indicates that the concerned part of the audio signal comprises speech, the error concealment method which is more suitable for speech than music could be selected. Correspondingly, when the stability value or parameter indicates that the concerned part of the audio signal comprises music, the error concealment method which is more suitable for music than for speech could be selected.

A novelty of the method for codec adaptation described herein is to use a range of the quantized envelope of a segment of the audio signal (in the transform domain) for determining a stability parameter. The difference D(m) between a range of the envelope in, adjacent frames may be computed as:

$$D(m) = \sqrt{\frac{1}{b_{end} - b_{start} + 1} \sum_{b=b_{start}}^{b_{end}} (E(m, b) - E(m-1, b))^2}$$

The bands $b_{start}, \ldots, b_{end}$ denote the range of bands which is used for the envelope difference measure. It may be a continuous range of bands, or, the bands may be disjoint, in which case the expression $b_{start}-b_{end}+1$ needs to be replaced with the correct number of bands in the range. Note that in the calculation for the very first frame, the values E(m−1,b) do not exist, and is therefore initialized, e.g. to envelope values corresponding to an empty spectrum.

The low pass filtering of the determined difference D(m) is performed to achieve a more stable control parameter. One solution is to use a first order AR (autoregressive) filter, or a forgetting factor, of the form:

$$\tilde{D}(m)=\alpha D(m)+(1-\alpha)D(m-1)$$

where α is a configuration parameter of the AR filter.

Figure 3A:
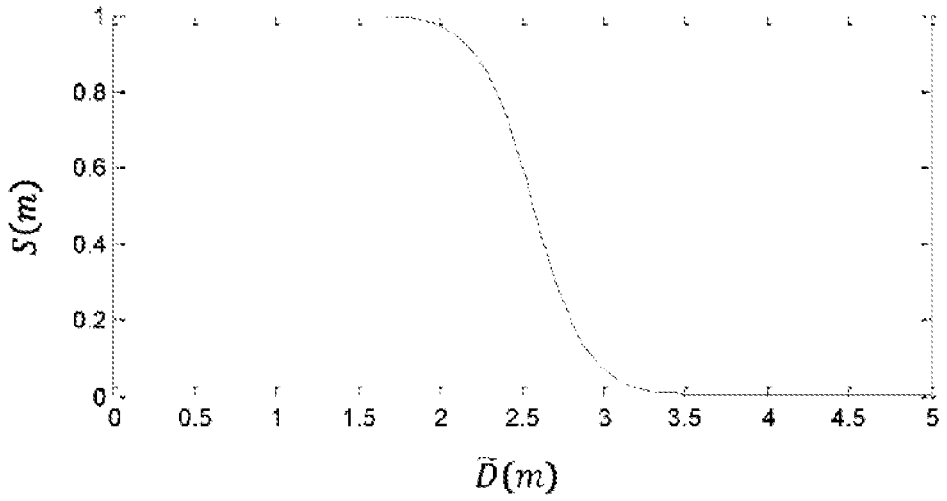
FIG. 3*a* is a schematic graph illustrating mapping curve from a filtered stability value to a stability parameter.
Figure 3B:
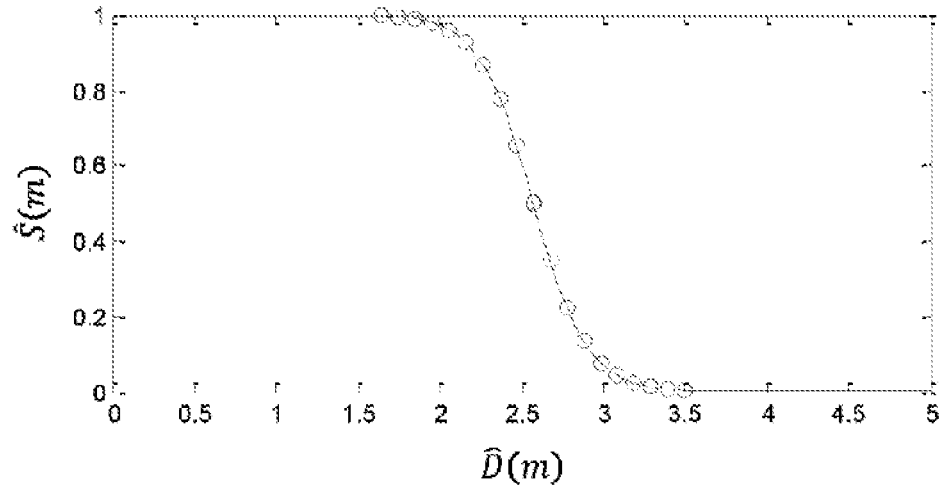
FIG. 3*b* is a schematic graph illustrating a mapping curve from a filtered stability value to a stability parameter, where the mapping curve is obtained from discrete values.

In order to facilitate the use of the filtered difference, or stability value $\tilde{D}(m)$, in the codec/decoder, it may be desirable to map the filtered difference $\tilde{D}(m)$ to a more suitable usage range. Here, a sigmoid function is used to map the value $\tilde{D}(m)$ to the [0, 1] range, as:

$$S(m) = \frac{1}{1 + e^{b((d\tilde{D}(m)):c)}}$$

where S(m)∈[0,1] denotes the mapped stability value. In an exemplifying embodiment, the constants b, c, d may be set to b=6.11, c=1.91 and d=2.26, but b, c and d can be set to any suitable value. The parameters of the sigmoid function may be set experimentally such that it adapts the observed dynamic range of the input parameter $\tilde{D}(m)$ to the desired output decision S(m). The sigmoid function offers a good mechanism for implementing a soft-decision threshold since both the inflection point and operating range may be controlled. The mapping curve is shown in FIG. 3*a*, where $\tilde{D}(m)$ is on the horizontal axis and S(m) is on the vertical axis. Since the exponential function is computationally complex, it may be desirable to replace the mapping function with a lockup-table. In that case, the mapping curve would be sampled in discrete points for pairs of $\tilde{D}(m)$ and S(m), as indicated by the circles in FIG. 3*b*. In the sampled case, if preferred, $\tilde{D}(m)$ and S(m) may be denoted e.g. $\hat{D}(m)$ and $\hat{S}(m)$, in which case the suitable lookup-table value $\hat{S}(m)$ is found by locating the closes value, $\hat{D}(m)$, to $\tilde{D}(m)$, for instance by using Euclidian distance. It may also be noted that the sigmoid function can be represented with only one half of the transition curve due to the symmetry of the function. The midpoint of the sigmoid function $S_{mid}$ is defined as $S_{mid}$=c/b+d. By subtracting the midpoint $S_{mid}$ as:

$$D'(m)=|D(m)-s_{mid}|$$

we can obtain the corresponding one-sided mapped stability parameter S'(m) using a quantization and lookup as described before, and the final stability parameter derived depending on the position relative to the midpoint as:

$$\begin{cases} \tilde{S} = 1 - D'(m), & \tilde{D}(m) < s_{mid} \\ \tilde{S} = D'(m), & \tilde{D}(m) \geq s_{mid} \end{cases}$$

Further, it may be desirable to apply a hangover logic or hysteresis the envelope stability measure. It may also be desirable to complement the measure with a transient detector. An example of a transient detector using hangover logic will be outlined further below.

A further embodiment addresses the need to generate an envelope stability measure that in itself is more stable and less subject to statistical fluctuations. As mentioned above, one possibility is to apply a hangover logic or hysteresis to the envelope stability measure. In many cases this may, however, not be sufficient, and on the other hand, in some cases, it is sufficient to merely generate a discrete output with a limited number of stability degrees. For such a case, it has been found advantageous to use a smoother employing a Markov model. Such a smoother would provide more stable, i.e. less fluctuating output values than what can be achieved with applying a hangover logic or hysteresis to the envelope stability measure. If referring back e.g. to the exemplifying embodiments in FIG. 2*a* and/or 2*b*, the selection of a decoding mode, e.g. a decoding method and/or an error concealment method, based on a stability value or parameter may further be based on a Markov model defining state transition probabilities related to transitions between different signal properties in the audio signal. The different states could e.g. represent speech and music. The approach of using a Markov model for generating a discrete output with a limited number of stability degrees will now be described.

Markov Model

The Markov model used comprises M states, where each state represents a certain degree of envelope stability. In case M is chosen to 2, one state (state 0) could represent strongly fluctuant spectral envelopes while the ether state (state 1) could represent stable spectral envelopes. It is without any conceptual difference possible to extend this model to more states, for instance for intermediate envelope stability degrees.

This Markov state model is characterized by state transition probabilities that represent the probabilities to go from each given state in a previous time instant to a given state at the current time instant. For example, the time instants could correspond to the frame indices m for the current frame and m−1 for the previously correctly received frame. Note that in case of frame losses due to transmission errors, this may be a frame different from a previous frame that would have been available without frame loss. The state transition probabilities can be written in a mathematical expression as a transition matrix T, where each element represents the probability p(j|i) for transiting to state j when emerging from state i. For the preferred 2-state Markov model, the transition probability matrix looks as follows.

$$T = \begin{bmatrix} p(0|0) & p(0|1) \\ p(1|0) & p(1|1) \end{bmatrix}.$$

It can be noted that the desired smoothing effect is achieved through setting likelihoods for staying in a given state to relatively large values, while the likelihood(s) for leaving this state get small values.

In addition, each state is associated with a probability at a given time instant. At the instance of the previous correctly received frame the state probabilities are given by a vector $$P_S(m-1) = \begin{bmatrix} p_{S,0}(m-1) \\ p_{S,1}(m-1) \end{bmatrix}.$$

In order to calculate the a priori likelihoods for the occurrence of each state, the state probability vector $P_S(m-1)$ is multiplied with the transition probability matrix:

$$P_A(m)=T\cdot P_S(m-1).$$

The true state probabilities do, however, not only depend on these a priori likelihoods but also on the likelihoods associated with the current observation $P_P(m)$ at the present frame time instant m. According to embodiments presented herein, the spectral envelope measurement values to be smoothed are associated with such observation likelihoods. As state 0 represents fluctuant spectral envelopes and state 1 represents stable envelopes, a low measurement value of envelope stability D(m) means high probability for state 0 and low probability for state 1. Conversely, if the measured, or observed envelope stability D(m) is large, this is associated with high probability for state 1 and low probability for state 0. A mapping of envelope stability measurement values to state observation likelihoods that is well suited for the preferred processing of the envelope stability values by means of the above described sigmoid function is a one-to-one mapping of D(m) to the state observation probability for state 1 and a one-to-one mapping of 1−D(m) to the state observation probability for state 0. That is, the output of the sigmoid function mapping may be the input to the Markov smoother:

$$P_P(m) = \begin{bmatrix} p_{P,0}(m) \\ p_{P,1}(m) \end{bmatrix} = \begin{bmatrix} 1 - D(m) \\ D(m) \end{bmatrix}.$$

It is to be noted that this mapping depends strongly on the used sigmoid function. Changing this function could require introducing remapping functions from 1−D(m) and D(m) to the respective state observation probabilities. A simple remapping that may also be done in addition to the sigmoid function is the application of an additive offset and of a scaling factor.

In a next processing step the vector of state observation probabilities $P_P(m)$ is combined with the vector of a priori probabilities $P_A(m)$, which gives the new state probability vector $P_S(m)$ for frame m. This combination is done by means of element-wise multiplication of both vectors:

$$\hat{P}_S(m) = \begin{bmatrix} \hat{p}_{S,0}(m) \\ \hat{p}_{S,1}(m) \end{bmatrix} = \begin{bmatrix} p_{P,0}(m)\cdot p_{A,0}(m) \\ p_{P,1}(m)\cdot p_{A,1}(m) \end{bmatrix}.$$

As the probabilities of this vector do not necessarily sum up to 1, the vector is re-normalized, which in turn yields the final state probability vector for frame in:

$$P_S(m) = \frac{1}{\sum_i \hat{p}_{S,i}} \hat{P}_S(m).$$

In a final step the most likely state for frame m is returned by the method as smoothed and discretized envelope stability measure. This requires identifying the maximum element in the state probability vector $P_S(m)$:

$$D_{smo}(m) = \max_i{}^{-1}\,(p_{S,i}(m)).$$

In order to make the described Markov based smoothing method work well for the envelope stability measure the state transition probabilities are selected in a suitable way. The following shows an example of a transition probability matrix that has been found to be very suitable for the task:

$$T = \begin{bmatrix} 0.999 & 0.5 \\ 0.001 & 0.5 \end{bmatrix}.$$

From the probabilities in this transition probability matrix it can be seen that the likelihood for staying in state 0 is very high 0.999 while the likelihood for leaving this state is small with its 0.001. Hence, the smoothing of the envelope stability measure is selective only for the case that the envelope stability measurement values indicate low stability. As the stability measurement values indicating a stable envelope are relatively stable by themselves, no further smoothing for them is considered to be needed. Accordingly, the transition likelihood values for leaving state 1 and for staying in state 1 are set equally to 0.5.

It is to be noted that increasing the resolution of the smoothed envelope stability measure can easily be achieved by increasing the number of states M.

A further enhancement possibility of the smoothing method of the envelope stability measure is to involve further measures that exhibit a statistical relationship with envelope stability. Such additional measures can be used in an analogue way as the association of the envelope stability measure observations D(m) with the state observation probabilities. In such a case, the state observation probabilities are calculated by an element-wise multiplication of the respective state observation probabilities of the different used measures.

It has been found that the envelope stability measure, and especially the smoothed measure, is particularly useful for speech/music classification. According to this finding, speech can be well associated with low stability measures and in particular with state 0 of the above described Markov model. Music, in contrast, can be well associated with high stability measures and in particular with state 1 of the Markov model.

For clarity, in a particular embodiment, the above described smoothing procedure is executed in the following steps at each time instant m:

1. Associate present envelope stability measurement value D(m) with state observation probabilities $P_P(m)$.
2. Calculate a priori probabilities $P_A(m)$ related to the state probabilities $P_S(m-1)$ at the earlier time instant m−1 and related to the transition probabilities T.
3. Multiply element-wise a priori probabilities $P_A(m)$ with state observation probabilities $P_P(m)$, including re-normalization, yielding the vector of state probabilities $P_S(m)$ for the current frame m.
4. Identify a state with largest probability in the vector of state probabilities $P_S(m)$ and return it as the final smoothed envelope stability measure $D_{smo}(m)$ far the current frame m.

Figure 4:
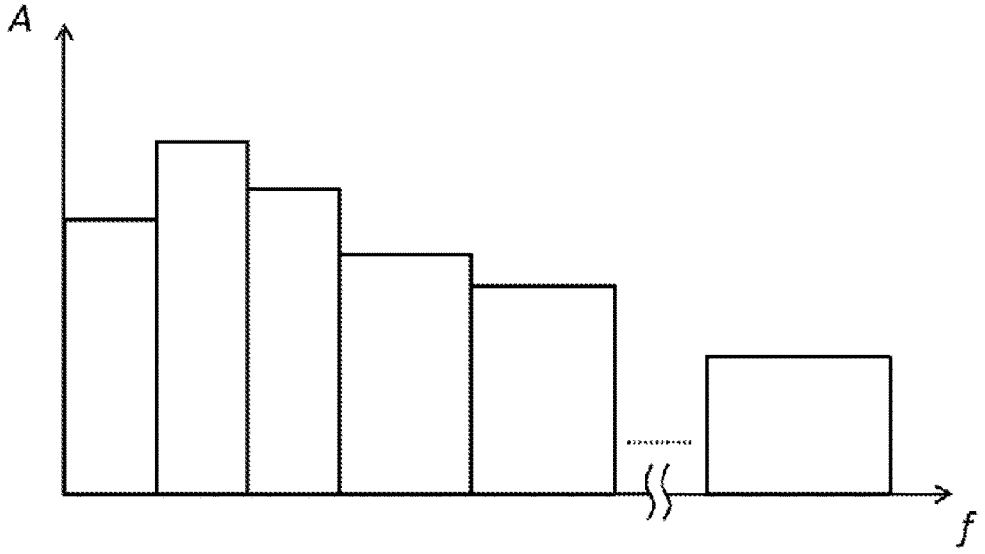
FIG. 4 is a schematic graph illustrating a spectral envelope of signals of received audio frames.

FIG. 4 is a schematic graph illustrating a spectral envelope 10 of signals of received audio frames, where the amplitude of each band is represented with a single value. The horizontal axis represents frequency and the vertical axis represents amplitude, e.g. power, etc. The figure illustrates the typical setup of increasing bandwidth for higher frequencies, but it should be noted that any type of uniform or non-uniform band partitioning may be used.

Transient Detection

As previously mentioned, it may be desirable to combine the stability value or stability parameter with a measure of the transient character of the audio signal. To achieve such a measure, a transient detector may be used. For example, it could be determined which type of noise fill or attenuation contra that should be used when decoding the audio signal based on the stability value/parameter and a transient measure. An example transient detector using hangover logic is outlined below. The term "hangover" is commonly used in audio signal processing and refers to the idea of delaying a decision to avoid unstable switching behavior in a transition period, when it is generally considered safe to delay the decision.

The transient detector uses different analysis depending on the coding mode. It has a hangover counter no_att_hangover to handle the hangover logic which is initialized to zero. The transient detector has a defined behavior for three different modes:

Mode A: Low band coding mode without envelope values

Mode B: Normal coding mode with envelope values

Mode C: Transient coding mode

The transient detector relies on a long-term energy estimate of the synthesis signal. It is updated differently depending on the coding mode.

Mode A

In Mode A, the frame energy estimate $E_{frameA}(m)$ is computed as $$E_{frameA}(m) = \sqrt{\frac{1}{\text{bin_th}} \sum_{k=0}^{bin_th} \hat{X}(m, k)^2}$$

where bin_th is the highest encoded coefficient in the synthesized low band of Mode A, and $\hat{X}(m,k)$ is the synthesized MDCT coefficients of frame m. In the encoder, these are reproduced using a local synthesis method which can be extracted in the encoding process, and they are identical to the coefficients obtained in the decoding process. The long term energy estimate $E_{LT}$ is update using a low-pass filter $$E_{LT}(m)=\beta E_{LT}(m-1)+(1-\beta)E_{frameA}(m)$$

where β is a filtering factor with an exemplary value of 0.93. If the hangover counter is larger than one, it is decremented.

$$\begin{cases} \text{no_at_hangover}(m) = \text{no_att_hangover}(m-1) - 1, & \text{no_att_hangover} > 0 \\ \text{no_at_hangover}(m) = \text{no_att_hangover}(m-1) & \text{no_att_hangover} = 0 \end{cases}$$

Mode B

The long term energy estimate $E_{frameB}(m)$ is updated based on the quantized envelope values $$E_{frameB}(m) = \sum_{b=0}^{B_{LF}} \hat{E}(m, b)$$

where $\beta_{LT}$ is the highest band included in the low frequency energy calculation. The long term energy estimate is updated in the same was as in Mode A:

$$E_{LT}(m)=\beta E_{LT}(m-1)+(1-\beta)E_{frameB}(m)$$

The hangover decrement is performed identically to Mode A.

Mode C

Mode C is a transient mode which encodes the spectrum in four subframes (each subframe corresponding to 1 ms in LTE). The envelope is interleaved into a pattern where part of the frequency order is kept. Four subframe energies $E_{sub,SF}$, SF=0, 1, 2, 3 are computed according to:

$$E_{sub,SF}(m) = \frac{1}{|\text{subframe}SF|} \sum_{b \in subframeSF} \hat{E}(m, b)$$

where subframeSF denotes the envelope bands b which represents subframe SF and |subframe SF| is the size of this set. Note that the actual implementation will depend on the arrangement of the interleaved subframes in the envelope vector.

The frame energy $E_{frameC}(m)$ is formed by summing the subframe energies:

$$E_{frameC}(m) = \sum_{sf=0}^{3} E_{sub,sf}(m)$$

The transient test is run for high energy frames by checking the condition $$E_{frameC(m)} > E_{THR} \cdot N_{SF}$$

where $E_{THR}$=100 is an energy threshold value and $N_{SF}$=4 is the number of subframes. If the above condition is passed, the maximum subframe energy difference is found $$D_{max}(m) = \max_{SF} \frac{(E_{sub,SF}(m) - E_{sub,SF-1}(m))}{E_{LT}(m)}, SF = 0, 1, 2, 3$$

Finally, if the condition $D_{max}(m) > D_{THR}$ is true, where $D_{THR}=5$ is a decision threshold which depends on the implementation and sensitivity setting, the hangover counter is set to the maximum value $$\begin{cases} \text{no_att_hangover}(m) = \text{no_att_hangover}(m-1) - 1, \\ \text{no_att_hangover} > 0 \wedge D_{max}(m) \leq D_{THR} \\ \text{no_att_hangover}(m) = \text{ATT_LIM_HANGOVER}, \\ D_{max}(m) > D_{THR} \end{cases}$$

where ATT LIM HANGOVER=150 is a configurable constant frame counter value. Now if the condition T(m) =no_att_hangover(m)>0 is true it means a transient has been detected and that the hangover counter has not yet reached zero.

The transient hangover decision T(m) may be combined with the envelope stability measure $\tilde{S}(m)$ such that the modifications depending on $\tilde{S}(m)$ are only applied when T(m) is true.

A particular problem is the calculation of the envelope stability measure in case of audio codecs that do not provide a representation of the spectral envelope in form of sub-band norms (or scale factors).

The following describes one embodiment solving this problem and still obtaining a useful envelope stability measure that is consistent with the envelope stability measure obtained based on sub-band norms or scale factors, as described above.

The first step of the solution is to find a suitable alternative representation of the spectral envelope of the given signal frame. One such representation is the representation based on linear predictive coefficients (LPC or short term prediction coefficients). These coefficients are a good representation of the spectral envelope if the LPC order P is properly chosen, which e.g. is 16 for wideband or super wideband signals. A representation of LPG parameters that is particularly suitable for coding, quantization and interpolation purposes are line spectral frequencies (LSF) or related parameters like e.g. ISF (immittance spectral frequencies) or LSP (line spectrum pairs). The reason is that these parameters exhibit a good relationship with the envelope spectrum of the corresponding LPG synthesis filter.

A prior art metric assessing the stability of LSF parameters of a current frame compared to those of a previous frame is known as LSF stability metric in the ITU-T G.718 codec. This LSF stability metric is used in the context of LPC parameter interpolation and in case of frame erasures. This metric is defined as follows:

$$\text{lsf_stab}(m) = a - b \cdot \sum_{i=1}^{P} (lsf_i(m) - lsf_i(m-1))^2,$$

where P is the LPC filter order a and b are some suitable constants. In addition, the lsf_stab metric may be limited to the interval from 0 to 1. A large number close to 1 means that the LSF parameters are very stable, i.e. not much changing, while a low value means that the parameters are relatively unstable.

One finding according to embodiments presented herein is that the LSF stability metric can also be used as a particularly useful indicator of the envelope stability as an alternative to comparing current and earlier spectral envelopes in form of sub-band norms (or scale factors). To that end, according to one embodiment, the lsf_stab parameter is calculated for a current frame (in relation to an earlier frame). Then, this parameter is resealed by a suitable polynomial transform like $$\hat{D}(m) = \sum_{n=0}^{N} \alpha_n (\text{lsf_stab}(m))^n,$$

where N is the polynomial order and $\alpha_n$ are the polynomial coefficients.

The rescaling, i.e. the setting of polynomial order and coefficients is done such that the transformed values $\hat{D}(m)$ behave as similarly as possible as the corresponding envelope stability values D(m) of the above. It is fauna that a polynomial order, of 1 is sufficient in many cases.

Figure 5A:
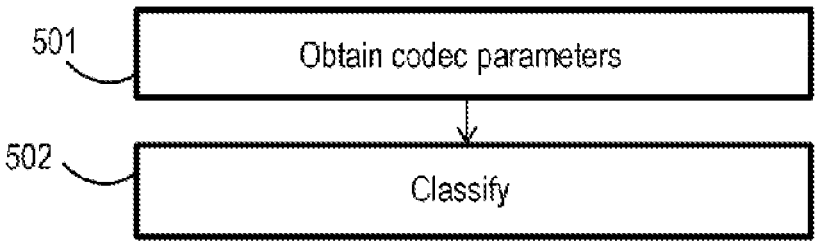
FIGS. 5*a-b* are flow charts illustrating methods performed in a host device for selecting a packet loss concealment procedure.
Figure 5B:
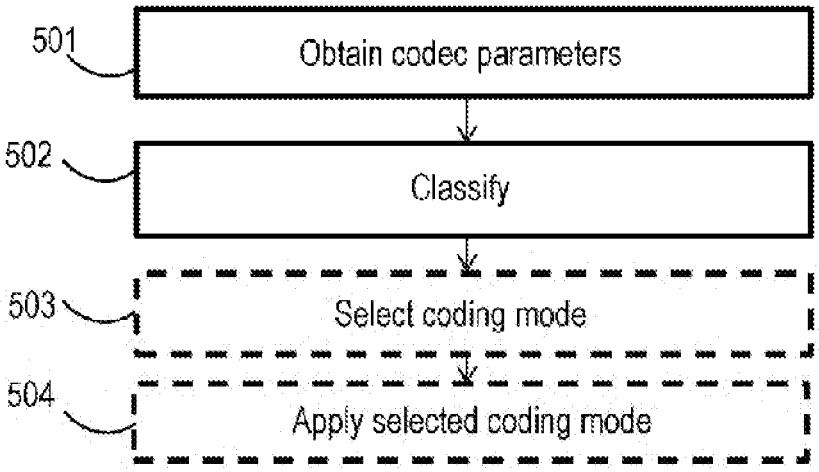

Classification, FIGS. 5*a* and 5*b*

The method described above may be described as a method for classifying a part of an audio signal, and where an adequate decoding, or encoding, mode or method may be selected based on the result of the classification.

FIGS. 5*a-b* are flow charts illustrating methods performed in an audio encoder of a host device, e.g. as a wireless terminal and/or transcoding node of FIG. 1, for assisting a selection of an encoding mode for audio.

In an obtain codec parameters step 501, codec parameters can be obtained. The codec parameters are parameters which are already available in the encoder or the decoder of the host device.

In a classify step 502, an audio signal is classified based on the rodeo parameters. The classification can e.g. be into voice or music. Optionally, hysteresis is used in this step, as explained in more detail above, to prevent hopping back and forth. Alternatively or additionally, a Markov model, such as a Markov chain, as explained in more detail above can be used to increase stability of the classifying.

For example, the classification can be based on an envelope stability measure of spectral information of audio data, which is then calculated in this step. This calculation can e.g. be based on a quantized envelope value.

Optionally, this step comprises mapping the stability measure to a predefined scalar range, as represented by S(m) above, optionally using a lookup table to reduce calculation demands.

The method may be repeated for each received frame of audio data.

FIG. 5*b* illustrates a method for assisting a selection of an encoding and/or decoding mode for audio according to one embodiment. This method is similar to the method illustrated in FIG. 5*a* and only new or modified steps, in relation to FIG. 5*a*, will be described.

In an optional select coding mode step 503, a coding mode is selected based on the classifying from the classify step 502.

In an optional encode step 504, audio data is encoded or decoded based on the coding mode selected in the select coding mode step 503.

Implementations

The method and techniques described above may be implemented in encoders and/or decoders, which may be part of e.g. communication devices.

Figure 6A:
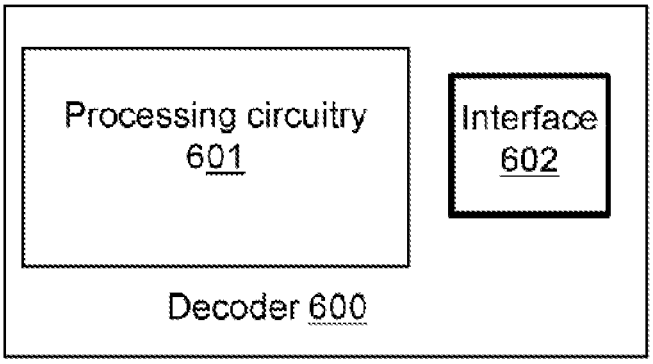
FIGS. 6*a-c* are schematic block diagrams illustrating different implementations of a decoder according to exemplifying embodiments.
Figure 6B:
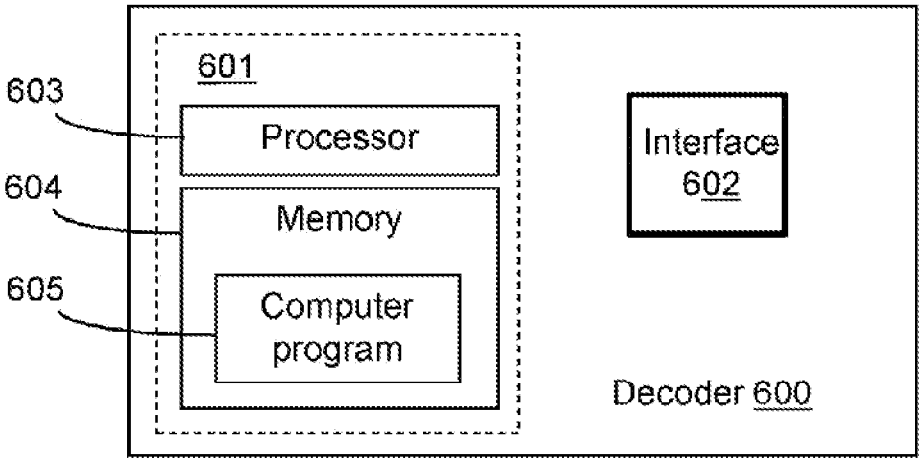
Figure 6C:
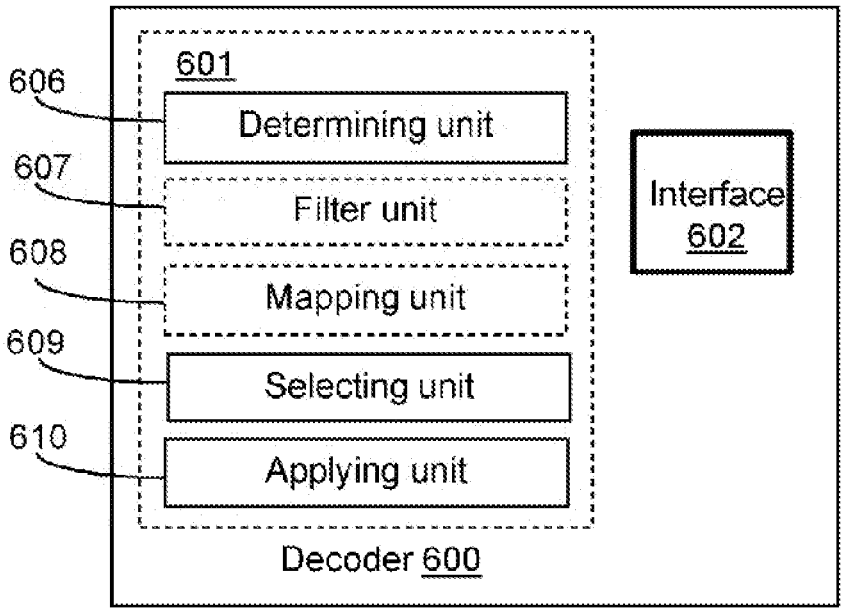

Decoder FIGS. 6*a*-6*c*

An exemplifying embodiment of a decoder is illustrated in a general manner in FIG. 6*a*. By decoder is referred to a decoder configured for decoding and possibly otherwise reconstructing audio signals. The decoder could possibly further be configured for decoding other types of signals. The decoder 600 is configured to perform at least one of the method embodiments described above with reference e.g. to FIGS. 2*a* and 2*b*. The decoder 600 is associated with the same technical features, objects and advantages as the previously described method embodiments. The decoder may be configured for being compliant with one or more standards for audio coding/decoding. The decoder will be described in brief in order to avoid unnecessary repetition.

The decoder may be implemented and/or described as follows:

The decoder 600 is configured for decoding of an audio signal. The decoder 600 comprises processing circuitry, or processing means 601 and a communication interface 602. The processing circuitry 601 is configured to cause the decoder 600 to, in a transform domain, for a frame m: determine a stability value D(m) based on a difference between a range of a spectral envelope of frame m and a corresponding range of a spectral envelope of an adjacent frame m−1, each range comprising a set of quantized spectral envelope values related to the energy in spectral bands of a segment of the audio signal. The processing circuitry 601 is further configured to cause the decoder to select a decoding mode out of a plurality of decoding modes based on the stability value D(m); and to apply the selected decoding mode.

The processing circuitry 601 may further be configured to cause the decoder to low pass filter the stability value D(m), thus achieving a filtered stability value $\tilde{D}(m)$; and to map the filtered stability value $\tilde{D}(m)$ to a scalar range of [0,1] by use of a sigmoid function, thus achieving a stability parameter S(m), based on which the decoding mode then is selected. The communication interface 602, which may also be denoted e.g. Input/Output (I/O) interface, includes an interface for sending data to and receiving data from other entitles or modules.

The processing circuitry 601 could, as illustrated in FIG. 6*b*, comprise processing means, such as a processor 603, e.g. a CPU, and a memory 604 for storing or holding instructions. The memory would then comprise instructions, e.g. in form of a computer program 605, which when executed by the processing means 603 causes the decoder 600 to perform the actions described above.

An alternative implementation of the processing circuitry 601 is shown in FIG. 6*c*. The processing circuitry here comprises a determining unit 606, configured to cause the decoder 600 to: determine a relation determine a stability value D(m) based on a difference between a range of a spectral envelope of frame m and a corresponding range of a spectral envelope of an adjacent frame m−1, each range comprising a set of quantized spectral envelope values related to the energy in spectral bands of a segment of the audio signal. The processing circuitry further comprises a selecting unit 609, configured to cause the decoder to select a decoding mode out of a plurality of decoding modes based on the stability value D(m). The processing circuitry further comprises an applying unit or decoding unit 610, configured to cause the decoder to apply the selected decoding mode. The processing circuitry 601 could comprise more units, such as a filter unit 607 configured to cause the decoder to low pass filter so the stability value D(m), thus achieving a filtered stability value $\tilde{D}(m)$. The processing circuitry may further comprise a mapping unit 608, configured to cause the decoder to map the filtered stability value $\tilde{D}(m)$ to a scalar range of [0,1] by use of a sigmoid function, thus achieving a stability parameter S(m), based on which the decoding mode then is selected. These optional units are illustrated with a dashed outline in FIG. 6*c*.

The decoders, or codecs, described above could be configured for the different method embodiments described herein, such as using a Markov model and selecting between different decoding modes associated with error concealment.

The encoder 600 may be assumed to comprise further functionality, for carrying out regular decoder functions.

Figure 7A:
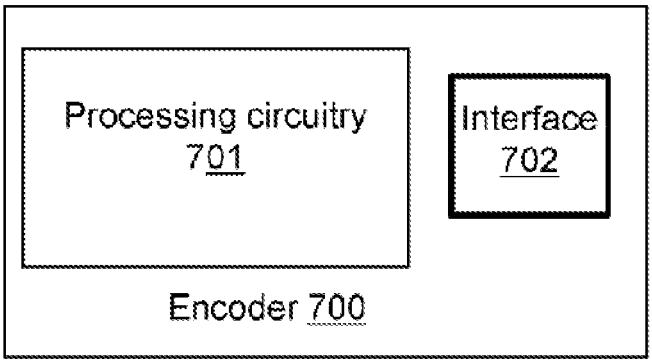
FIGS. 7*a-c* are schematic block diagrams illustrating different implementations of an encoder according to exemplifying embodiments.
Figure 7B:
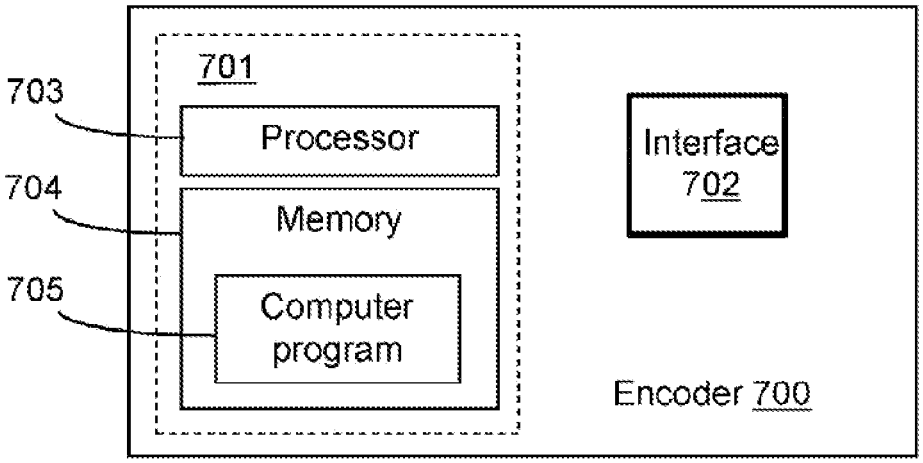
Figure 7C:
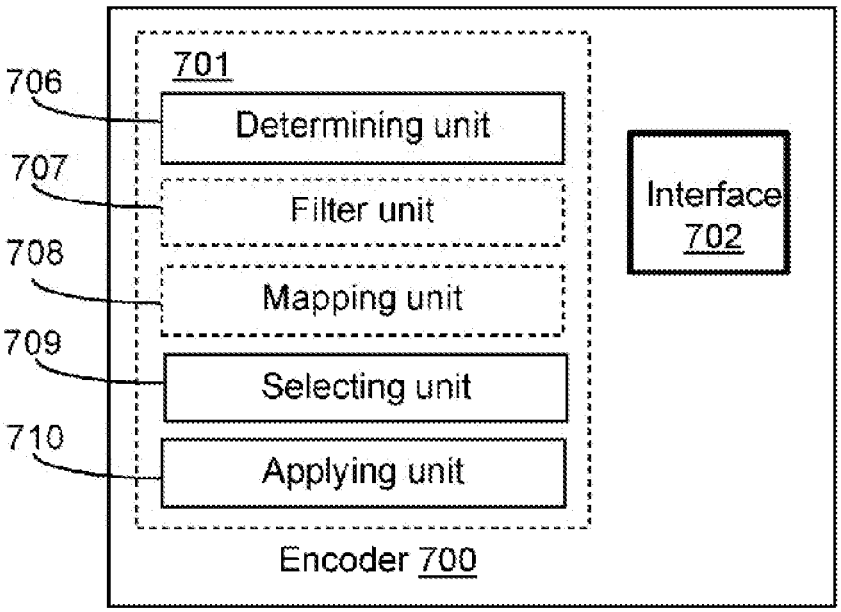

Encoder, FIGS. 7*a*-7*c*

An exemplifying embodiment of an encoder is illustrated in a general manner in FIG. 7*a*. By encoder is referred to an encoder configured for encoding of audio signals. The encoder could possibly further be configured for encoding other types of signals. The encoder 700 is configured to perform at least one method corresponding to the decoding methods described above with reference e.g. to FIGS. 2*a* and 2*b*. That is, instead of selecting a decoding mode, as in FIGS. 2*a* and 2*b*, an encoding mode is selected and applied. The encoder 700 is associated with the same technical features, objects and advantages as the previously described method embodiments. The encoder may be configured for being compliant with one or more standards for audio encoding/decoding. The encoder will be described in brief in order to avoid unnecessary repetition.

The encoder may be implemented and/or described as follows:

The encoder 700 is configured for encoding of an audio signal. The encoder 700 comprises processing circuitry, or processing means 701 and a communication interface 702. The processing circuitry 701 is configured to cause the encoder 700 to, in a transform domain, for a frame m: determine a stability value D(m) based on a difference between a range of a spectral envelope of frame m and a corresponding range of a spectral envelope of an adjacent frame m−1, each range comprising a set of quantized spectral envelope values related to the energy in spectral bands of a segment of the audio signal. The processing circuitry 701 is further configured to cause the encoder to select an encoding mode out of a plurality of encoding modes based on the stability value D(m); and to apply the selected encoding mode.

The processing circuitry 701 may further be configured to cause the encoder to low pass filter the stability value D(m), thus achieving a filtered stability value $\tilde{D}(m)$; and to map the filtered stability value $\tilde{D}(m)$ to a scalar range of [0,1] by use of a sigmoid function, thus achieving a stability parameter S(m), based on which the encoding mode then is selected. The communication interface 702, which may also be denoted e.g. Input/Output (I/O) interface, includes an interface for sending data to and receiving data from other entities or modules.

The processing circuitry 701 could, as illustrated in FIG. 7*b*, comprise processing means, such as a processor 703, e.g. a CPU, and a memory 704 for storing or holding instructions. The memory would then comprise instructions, e.g. in form of a computer program 705, which when executed by the processing means 703 causes the encoder 700 to perform the actions described above.

An alternative implementation of the processing circuitry 701 is shown in FIG. 7*c*. The processing circuitry here comprises a determining unit 706, configured to cause the encoder 700 to: determine a relation determine a stability value D(m) based on a difference between a range of a spectral envelope of frame m and a corresponding range of a spectral envelope of an adjacent frame m−1, each range comprising a set of quantized spectral envelope values related to the energy in spectral bands of a segment of the audio signal. The processing circuitry further comprises a selecting unit 709, configured to cause the encoder to select an encoding mode out of a plurality of encoding modes based on the stability value D(m). The processing circuitry further comprises an applying unit or encoding unit 710, configured to cause the encoder to apply the selected encoding mode. The processing circuitry 701 could comprise more units, such as a filter unit 707 configured to cause the encoder to low pass filter the stability value D(m), thus achieving a filtered stability value $\tilde{D}(m)$. The processing circuitry may further comprise a mapping unit 708, configured to cause the encoder to map the filtered stability value $\tilde{D}(m)$ to a scalar range of [0,1] by use of a sigmoid function thus achieving a stability parameter S(m), based on which the decoding mode then is selected. These optional units are illustrated with a dashed outline in FIG. 7*c*.

The encoders, or codecs, described above could be configured for the different method embodiments described herein, such as using a Markov model.

The encoder 701 may be assumed to comprise further functionality, for carrying out regular encoder functions.

Figure 8A:
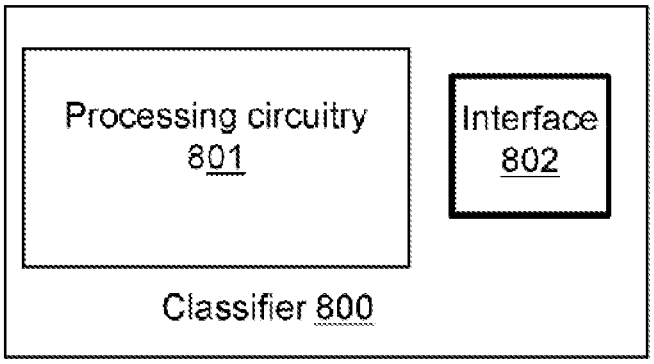
FIGS. 8*a-c* are schematic block diagrams illustrating different implementations of a classifier according to exemplifying embodiments.
Figure 8B:
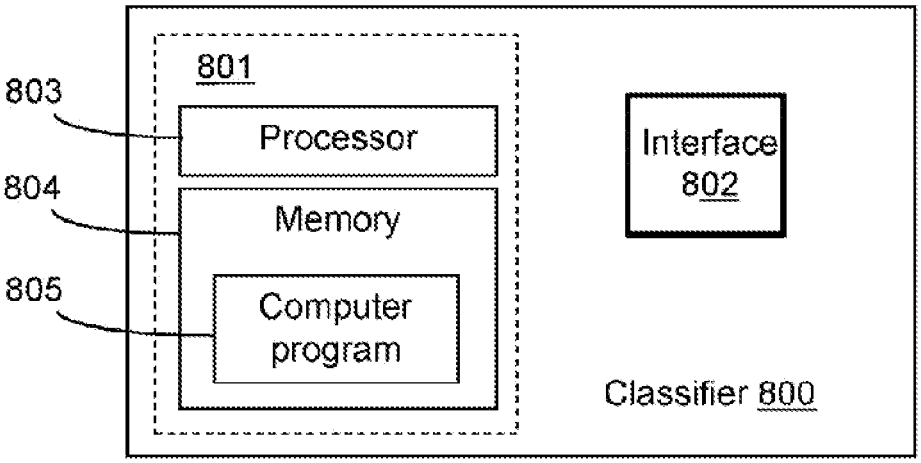
Figure 8C:
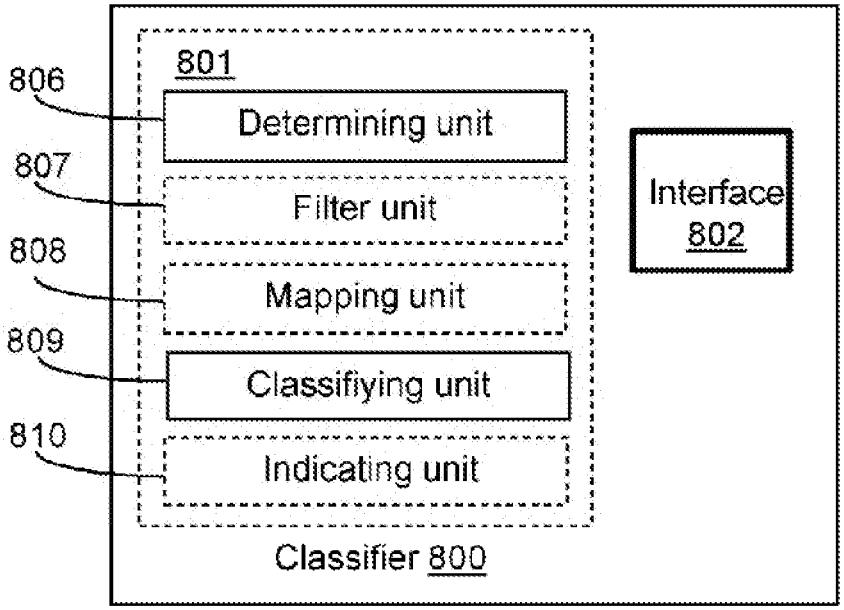

Classifier, FIGS. 8*a*-8*c*

An exemplifying embodiment of a classifier is illustrated in a general manner in FIG. 8*a*. By classifier is referred to a classifier configured for classifying of audio signals, i.e. discriminating between different types or classes of audio signals. The classifier 800 is configured to perform at least one method corresponding to the methods described above with reference e.g. to FIGS. 5*a* and 5*b*. The classifier 800 is associated with the same technical features, objects and advantages as the previously described method embodiments. The classifier may be configured for being compliant with one or more standards for audio encoding/decoding. The classifier will be described in brief in order to avoid unnecessary repetition.

The classifier may be implemented and/or described as follows:

The classifier 800 is configured for classifying an audio signal. The classifier 800 comprises processing circuitry, or processing means 801 and a communication interface 802. The processing circuitry 801 is configured to cause the classifier 800 to, in a transform domain, for a frame m: determine a stability value D(m) based on a difference between a range of a spectral envelope of frame m and a corresponding range of a spectral envelope of an adjacent frame m−1, each range comprising a set of quantized spectral envelope values related to the energy in spectral bands of a segment of the audio signal. The processing circuitry 801 is further configured to cause the classifier to classify the audio signal based on the stability value D(m). For example, the classification may involve selecting an audio signal class from a plurality of candidate audio signal classes. The processing circuitry 801 may further be configured to cause the classifier to indicate the classification for use e.g. by a decoder or encoder.

The processing circuitry 801 may further be configured to cause the classifier to low pass filter the stability value D(m), thus achieving a filtered stability value $\tilde{D}(m)$; and to map the filtered stability value $\tilde{D}(m)$ to a scalar range of [0,1] by use of a sigmoid function, thus achieving a stability parameter S(m), based on which the audio signal may be classified. The communication interface 802, which may also be denoted e.g. Input/Output (I/O) interface, includes an interface for sending data to and receiving data from other entities or modules.

The processing circuitry 801 could, as illustrated in FIG. 8*b*, comprise processing means, such as a processor 803, e.g. a CPU, and a memory 804 for storing or holding instructions. The memory would then comprise instructions, e.g. in form of a computer program 805, which when executed by the processing means 803 causes the classifier 800 to perform the actions described above.

An alternative implementation of the processing circuitry 801 is shown in FIG. 8*c*. The processing circuitry here comprises a determining unit 806, configured to cause the classifier 800 to: determine a relation determine a stability value D(m) based on a difference between a range of a spectral envelope of frame m and a corresponding range of a spectral envelope of an adjacent frame m−1, each range comprising a set of quantized spectral envelope values related to the energy in spectral bands of a segment of the audio signal. The processing circuitry further comprises a classifying unit 809, configured to cause the classifier to classify the audio signal. The processing circuitry may further comprise an indicating unit 810, configured to cause the classifier to indicate the classification e.g. to an encoder or a decoder. The processing circuitry 801 could comprise more units, such as a filter unit 807 configured to cause the classifier to low pass filter the stability value D(m), thus achieving a filtered stability value $\tilde{D}(m)$. The processing circuitry may further comprise a mapping unit 808 configured to cause the classifier to map the filtered stability value $\tilde{D}(m)$ to a scalar range of [0,1] by use of a sigmoid function, thus achieving a stability parameter S(m), based on which the audio signal may be classified. These optional units are illustrated with a dashed outline in FIG. 8*c*.

The classifiers described above could be configured for the different method embodiments described herein, such as using a Markov model.

The classifier 800 may be assumed to comprise further functionality, for carrying out regular classifier functions.

Figure 9:
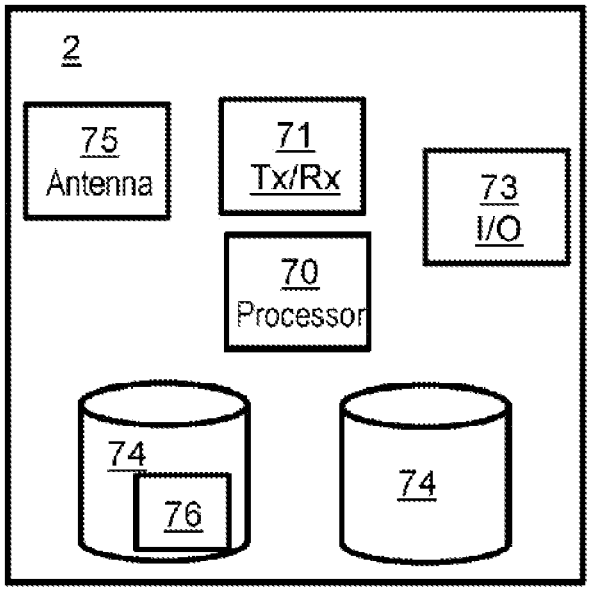
FIG. 9 is a schematic diagram showing some components of a wireless terminal.

FIG. 9 is a schematic diagram showing some components of a wireless terminal 2 of FIG. 1. A processor 70 is provided using any combination of one or more of a suitable central processing unit (CPU), multiprocessor, microcontroller, digital signal processor (DSP), application specific integrated circuit etc., capable of executing software instructions 76 stored in a memory 74, which can thus be a computer program product. The processor 70 can execute the software instructions 76 to perform any one or more embodiments of the methods described with reference to FIGS. 5*a*-*b* above.

The memory 74 can be any combination of read and write memory (RAM) and read only memory (ROM). The memory 74 also comprises persistent storage, which, for example, can be any single one or combination of magnetic memory, optical memory, solid state memory or even remotely mounted memory.

A data memory 73 is also provided for reading and/or storing data during execution of software instructions in the processor 70. The data memory 73 can be any combination of read and write memory (RAM) and read only memory (ROM).

The wireless terminal 2 further comprises an I/O interface 72 for communicating with other external entities. The I/O interface 72 also includes a user interface comprising a microphone, speaker, display, etc. Optionally, an external microphone and/or speaker/headphone can be connected to the wireless terminal.

The wireless terminal 2 also comprises one or more transceivers 71, comprising analogue and digital components, and a suitable number of antennas 75 for wireless communication with wireless terminals as shown in FIG. 1.

The wireless terminal 2 comprises an audio encoder and an audio decoder. These may be implemented in the software instructions 76 executable by the processor 70 or using separate hardware (not shown).

Other components of the wireless terminal 2 are omitted in order not to obscure the concepts presented herein.

Figure 10:
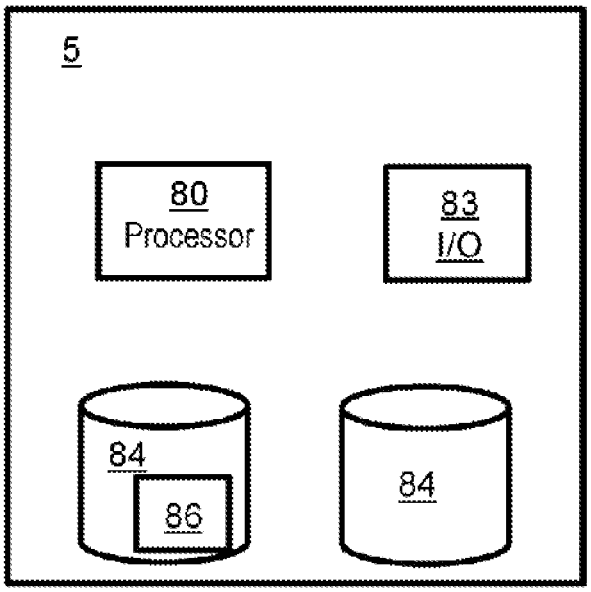
FIG. 10 is a schematic diagram showing some components of a transcoding node.

FIG. 10 is a schematic diagram showing some components of the transcoding node 5 of FIG. 1. A processor 80 is provided using any combination of one or more of a suitable central processing unit (CPU), multiprocessor, microcontroller digital signal processor (DSP), application specific integrated circuit etc., capable of executing software instructions 66 stored in a memory 84, which can thus be a computer program product. The processor 80 can be configured to execute the software instructions 86 to perform any one or more embodiments of the methods described with reference to FIGS. 5*a-b* above.

The memory 84 can be any combination of read and write memory (RAM) and read only memory (ROM). The memory 84 also comprises persistent storage, which, for example, can be any single one or combination of magnetic memory, optical memory, solid state memory or even remotely mounted memory.

A data memory 83 is also provided for reading and/or storing data during execution of software instructions in the processor 80. The data memory 83 can be any combination of read and write memory (RAM) and read only memory (ROM).

The transcoding node 5 further comprises an I/O interface 82 for communicating with other external entities such as the wireless terminal of FIG. 1, via the radio base station 1.

The transcoding node 5 comprises an audio encoder and an audio decoder. These may be implemented in the software instructions 86 executable by the processor 80 or using separate hardware (not shown).

Other components of the transcoding node 5 are omitted in order not to scare the concepts presented herein.

Figure 11:
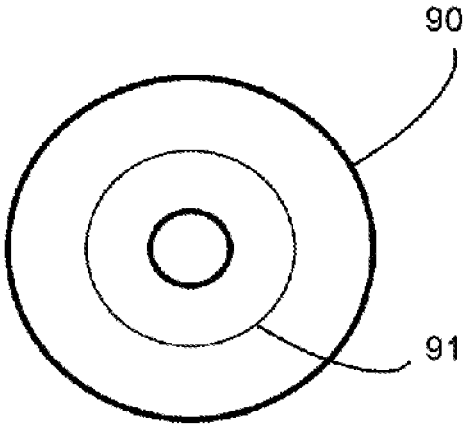
FIG. 11 shows one example of a computer program product comprising computer readable means.

FIG. 11 shows one example of a computer program product 90 comprising computer readable means. On this computer readable means a computer program 91 can be stored, which computer program can cause a processor to execute a method according to embodiments described herein. In this example, the computer program product is an optical disc, such as a CD (compact disc) or a DVD (digital versatile disc) or a Blu-Ray disc. As explained above the computer program product could also be embodied in a memory of a device, such as the computer program product 74 of FIG. 7 or the computer program product 84 of FIG. 8. While the computer program 91 is here schematically shown as a track on the depicted optical disk, the computer program can be stored in any way which is suitable for the computer program product, such as a removable solid state memory (e.g. a Universal Serial Bus (USB) stick).

Here now follows a set of enumerated embodiments to further exemplify some aspects the inventive concepts presented herein.

1. A method for assisting a selection of an encoding or decoding mode for audio, the method being performed in an audio encoder or decoder and comprising the steps of:

obtaining (501) codec parameters; and classifying (502) an audio signal based on the coded parameters.

2. The method according to embodiment 1, further comprising the step of:

selecting (503) a coding mode based on the classifying.

3. The method according to embodiment 2, further comprising the step of:

encoding or decoding (504) audio data based on the coding mode selected in the selecting step.

4. The method according to any one of the preceding embodiments, wherein the step of classifying (502) the audio signal comprises the use of hysteresis.

5. The method according to any one of the preceding embodiments, wherein the step of classifying (502) the audio signal comprises the use of a Markov chain.

6. The method according to any one of the preceding embodiments, wherein the step of classifying (502) comprises calculating an envelope stability measure of spectral information of audio data.

7. The method according to embodiment 6, wherein, in the step of classifying, the calculating an envelope stability measure is based on a quantized envelope value.

8. The method according to embodiment 6 or 7, wherein the step of classifying comprises mapping the stability measure to a predefined scalar range.

9. The method according to embodiment 8, wherein the step of classifying comprises mapping the stability measure to a predefined scalar range using a lookup table.

10. The method according to any of the preceding embodiments, wherein the envelope stability measure is based on a comparison of envelope characteristics in a frame m, and a preceding frame, m−1.

11. A host device (2, 5) for assisting a selection of an encoding mode for audio, the host device comprising:

a processor (70, 80); and a memory (74, 84) storing instructions (76, 86) that, when executed by the processor, causes the host device (2, 5) to:

obtain codec parameters; and classify an audio signal based on the codec parameters.

12. The host device (2, 5) according to embodiment 11, further comprising instructions that, when executed by the processor, causes the host device (2, 5) to select a coding mode based on the classifying.

13. The host device (2, 5) according to embodiment 12, further comprising instructions that, when executed by the processor, causes the host device (2, 5) to encode audio data based on the selected coding mode.

14. The host device (2, 5) according to any one of embodiments 11 to 13, wherein the instructions to classify the audio signal comprise instructions that, when executed by the processor, causes the host device (2, 5) to use hysteresis.

15. The host device (2, 5) according to any one of embodiments 11 to 14, wherein the instructions to classify the audio signal comprise instructions that, when executed by the processor, causes the host device (2, 5) to use a Markov chain.

16. The host device (2, 5) according to any one of embodiments 11 to 15, wherein the instructions to classify comprise instructions that, when executed by the processor, causes the host device (2, 5) to calculate an envelope stability measure of spectral information of audio data.

17. The host device (2, 5) according to embodiment 16, wherein, the instructions to classify comprise instructions that, when executed by the processor, causes the host device (2, 5) to calculate an envelope stability measure based on a quantized envelope value.

18. The host device (2, 5) according to embodiment 16 or 17, wherein the instructions to classify comprise instructions that, when executed by the processor, causes the host device (2, 5) to map the stability measure to a predefined scalar range.

19. The host device (2, 5) according to embodiment 18, wherein the instructions to classify comprise instructions that, when executed by the processor, causes the host device (2, 5) to map the stability measure to a predefined scalar range using a lookup table.

20. The host device (2, 5) according to any of embodiments 11-19, wherein, the instructions to classify comprise instructions that, when executed by the processor, causes the host device (2, 5) to calculate an envelope stability measure based on a comparison of envelope characteristics in a frame, m, and a preceding frame, m−1.

21. A computer program (66, 91) for assisting a selection of an encoding mode for audio, the computer program comprising computer program code which, when run on a host device (2, 5) causes the host device (2, 5) to:

obtain codec parameters; and classify an audio signal based on the codec parameters.

22. A computer program product (74, 84, 90) comprising a computer program according to embodiment 21 and a computer readable means on which the computer program is stored.

The invention has mainly been described above with reference to a few embodiments. However, as is readily appreciated by a person skilled in the art, other embodiments than the ones disclosed above are equally possible within the scope of the invention.

CONCLUDING REMARKS

The steps, functions, procedures, modules, units and/or blocks described herein may be implemented in hardware using any conventional technology, such as discrete circuit or integrated circuit technology, including both general-purpose electronic circuitry and application-specific circuitry.

Particular examples include one or more suitably configured digital signal processors and other known electronic circuits, e.g. discrete logic gates interconnected to perform a specialized function, or Application Specific Integrated Circuits (ASICs).

Alternatively, at least some of the steps, functions, procedures modules, units and/or blocks described above may be implemented in software such as a computer program for execution by suitable processing circuitry including one or more processing units. The software could be carried by a carrier, such as an electronic signal, an optical, signal, a radio signal, or a computer readable storage medium before and/or during the use of the computer program in the network nodes. The network node and indexing server described above may be implemented in a so-called cloud solution, referring to that the implementation may be distributed, and the network node and indexing server therefore may be so-called virtual nodes or virtual machines.

The flow diagram or diagrams presented herein may be regarded as a computer flow diagram or diagrams, when performed by one or more processors. A corresponding apparatus may be defined as a group of function modules, where each step performed by the processor corresponds to a function module. In this case the function modules are implemented as a computer program running on the processor.

Examples of processing circuitry includes, but is not limited to, one or more microprocessors, one or more Digital Signal Processors, DSPs one or more Central Processing Units CPUs, and/or any suitable programmable logic circuitry such as one or more Field Programmable Gate Arrays, FPGAs, or one or more Programmable Logic Controllers, PLCs. That is, the units or modules in the arrangements in the different nodes described above could be implemented by a combination of analog and digital circuits, and/or one or more processors configured with software and/or firmware, e.g. stored in a memory. One or more of these processors, as well as the other digital hardware may be included in a single application-specific integrated circuitry, ASIC, or several processors and various digital hardware may be distributed among several separate components whether individually packaged or assembled into a system-on-a-chip, SoC.

It should also be understood that it may be possible to re-use the general processing capabilities of any conventional device or unit in which the proposed technology is implemented. It may also be possible to re-use existing software, e.g. by reprogramming of the existing software or by adding new software components.

The embodiments described above are merely given as examples and it should be understood that the proposed technology is not limited thereto. It will be understood by those skilled in the art that various modifications, combinations and changes may be made to the embodiments without departing from the present scope. In particular, different part solutions in the different embodiments can be combined in other configurations, where technically possible.

When using the word "comprise" or "comprising" it shall be interpreted as non-limiting, i.e. meaning "consist at least of".

It should also be noted that in some alternate implementations, the functions/acts noted in the blocks may occur out of the order noted in the flowcharts. For example, two blocks shown in succession may in fact be executed substantially concurrently or the blocks may sometimes be executed in the reverse order, depending upon the functionality/acts involved. Moreover, the functionality of a given block of the flowcharts and/or block diagrams may be separated into multiple blocks and/or the functionality of two or more blocks of the flowcharts and/or block diagrams may be at least partially integrated. Finally, other blocks may be added/inserted between the blocks that are illustrated, and/or blocks/operations may be omitted without departing from the scope of inventive concepts.

It is to be understood that the choice of interacting units, as well as the naming of the units within this disclosure are only far exemplifying purpose, and nodes suitable to execute any of the methods described above may be configured in a plurality of alternative ways in order to be able to execute the suggested procedure actions.

It should also be noted that the units described In this disclosure are to be regarded as logical entities and not with necessity as separate physical entities.

The invention claimed is:

1. A method for decoding an audio signal, the method comprising:

determining a stability value D(m) based on a difference, in a transform domain, between a range of a spectral envelope of a frame m and a corresponding range of a spectral envelope of an adjacent frame m−1, each range comprising a set of quantized spectral envelope values related to the energy in spectral bands of a segment of the audio signal;

selecting a decoding mode out of a plurality of decoding modes based on the stability value D(m); and applying the selected decoding mode.

2. Method according to claim 1, further comprising:

low pass filtering the stability value D(m), thus achieving a filtered stability value $\tilde{D}(m)$;

mapping the filtered stability value $\tilde{D}(m)$ to a scalar range of [0,1] by use of a sigmoid function, thus achieving a stability parameter S(m);

and wherein the selecting of a decoding mode is based on the stability parameter S(m).

3. The method according to claim 1, wherein the selecting of a decoding mode comprises determining whether the segment of the audio signal represented in frame m comprises speech or music.

4. The method according to claim 1, wherein at least one decoding mode out of the plurality of decoding modes is more suitable for speech than for music, and at least one decoding mode is more suitable for music than for speech.

5. The method according to claim 1, wherein the selection of a decoding mode out of a plurality of decoding modes is related to error concealment.

6. The method according to claim 1, wherein the selection of a decoding mode is further based on a Markov model defining state transition probabilities related to transitions between speech and music in the audio signal.

7. The method according to claim 1, wherein the selection of a decoding mode is further based on a transient measure, indicating the transient structure of the spectral contents of frame m.

8. A non-transitory computer readable storage medium storing a computer program, comprising instructions which, when executed on at least one processor, cause the at least one processor to carry out the method according to claim 1.

9. A decoder for decoding an audio signal, the decoder being configured to:

determine a stability value D(m) based on a difference, in a transform domain, between a range of a spectral envelope of a frame m and a corresponding range of a spectral envelope of an adjacent frame m−1, each range comprising a set of quantized spectral envelope values related to the energy in spectral bands of a segment of the audio signal;

select a decoding mode out of a plurality of decoding modes based on the stability value D(m); and to apply the selected decoding mode.

10. The decoder according to claim 9, being further configured to:

low pass filter the stability value D(m), thus achieving a filtered stability value $\tilde{D}(m)$; and to map the filtered stability value $\tilde{D}(m)$ to a scalar range of [0,1] by use of a sigmoid function, thus achieving a stability parameter S(m);

and wherein the selecting of a decoding mode is based on the stability parameter S(m).

11. The decoder according to claim 9, wherein the selecting of a decoding mode is configured to comprise determining whether the segment of the audio signal represented in frame m comprises speech or music.

12. The decoder according to claim 9, wherein the selection of a decoding mode out of a plurality of decoding modes is related to error concealment.

13. The decoder according to claim 9, wherein the selecting of a decoding mode is configured to be based on a Markov model defining state transition probabilities related to transitions between speech and music in the audio signal.

14. The decoder according to claim 9, being configured to further base the selection of a decoding mode on a transient measure, indicating the transient structure of the spectral contents of frame m.

15. Host device comprising a decoder according to claim 9.

* * * * *